United States Patent [19]

Williams

[11] 4,004,488

[45] Jan. 25, 1977

[54] DUAL-MOTION FIRING DEVICE

[75] Inventor: George B. Williams, King George County, Va.

[73] Assignee: The United States of America as represented by the Secretary of the Navy, Washington, D.C.

[22] Filed: Apr. 1, 1975

[21] Appl. No.: 563,994

[52] U.S. Cl. ..... 89/27 A; 42/1 Z; 102/70 S; 244/122 A

[51] Int. Cl.[2] ..... F41F 13/04

[58] Field of Search ..... 42/1 R, 1 G, 1 H, 1 Z; 89/1 B, 1.5 D, 27 R, 27 A, 27 B, 27 L, 27 F, 27 G, 136; 102/70 S; 244/122 A, 122 AB, 122 AC, 122 AD; 294/83 AA

[56] References Cited

UNITED STATES PATENTS

| | | | |
|---|---|---|---|
| 1,319,103 | 10/1919 | Miller | 102/70 S |
| 1,372,944 | 3/1921 | Constantinesco | 89/136 |
| 3,762,267 | 10/1973 | Travor et al. | 89/1 B |
| 3,885,761 | 5/1975 | Pendergast et al. | 89/1 B |

*Primary Examiner*—Stephen C. Bentley
*Attorney, Agent, or Firm*—R. Sciascia; R. Beers; S. Sheinbein

[57] ABSTRACT

A dual-motion firing device having both its firing and its arming mechanisms internal to its tubular housing. A tubular sear is enclosed by the housing and, in turn, encloses an arming rod, both sear and rod extending out of the housing. A tubular firing pin capped and nippled on its forward end encloses the front end of the sear. Pushing the arming rod forward releases a ball which restrains the sear from rearward movement. Then, pulling the sear backward releases another ball which prevents forward motion of the firing pin and a spring propels the latter forward sharply.

7 Claims, 3 Drawing Figures

DUAL-MOTION FIRING DEVICE

BACKGROUND OF THE INVENTION

This invention relates to firing mechanisms and especially to a firing mechanism which requires two motions for actuation.

Existing dual-motion firing controls, especially those used for aircraft ejection seats, employ a single-action firing mechanism with an externally located arming mechanism. This might take the form of a hook-latch or other mechanical stop which is manually removed or released by the first motion. Locating this restraining mechanism external to the firing mechanism creates excessive bulk and weight. The reliability and simplicity of such existing alternatives must be individually analyzed but the merging of the two functions has great potential for reducing the complexity and increasing the reliability of firing mechanisms.

SUMMARY OF THE INVENTION

The objects and advantages of the present invention are accomplished by a dual-motion firing device in which the arming and firing mechanisms are both substantially internal to the same housing. Arming is effected by pushing in the arming pin so that the sear-restraining means is free and then pulling back the sear so as to free the firing-pin restraining means, thereby freeing the firing pin to spring forward and strike a cartridge.

An object of the invention is to provide a dual-motion firing mechanism in which the restraining mechanism is internal to the firing mechanism.

Another object is to reduce the bulk and weight of dual-motion firing mechanisms.

A further object is to simplify and increase the reliability of dual-motion firing mechanisms.

Other objects, advantages and novel features of the present invention will become apparent from the following detailed description of the invention when considered in conjunction with the accompanying drawing.

DETAILED DESCRIPTION OF THE INVENTION

Figure 1:
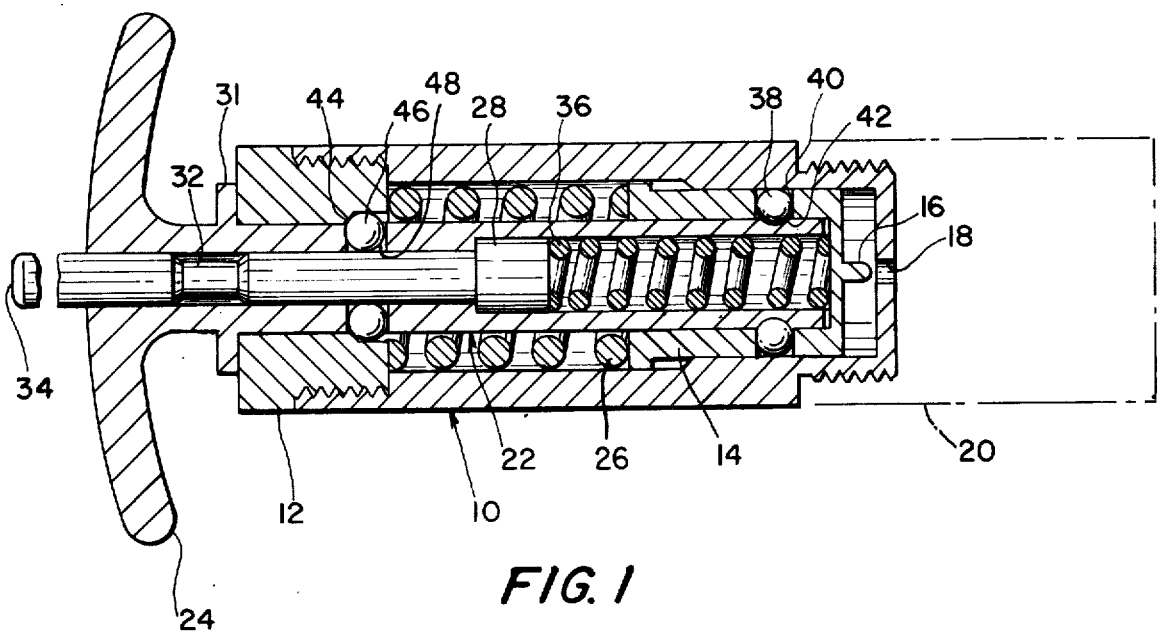
FIG. 1 is a cross-sectional view of an embodiment of the invention in the safetied, or unarmed, condition.

FIG. 1 shows a cross-sectional, side view of the firing device in its safetied, or unarmed, condition. A substantially cylindrical, firing-device housing 10 has a screw-in cap 12 at one end (at the rear end) and encompasses a firing pin 14 at the other (forward) end. The pin 14 has a nipple, or striker 16, at the other end, which is centrally located thereon to pass through a centrally located hole 18 in the forward or right (as seen in FIG. 1) end of the housing 10. A cartridge housing 20, shown in dashed lines, containing an explosive cartridge (not shown) may be coupled to the forward end of the firing-mechanism housing 10 so that the nipple 16 may strike and explode the cartridge under the proper conditions.

The firing pin 14 encloses the forward end of a sear 22 which extends out of the rear end of the housing 10 into a handle, or pulling means, 24. A firing-pin propelling means, or spring, 26, preferably a coil spring, extends between the rear end of the firing pin 14 and the front end of the housing cap 12, so that rearward motion of the firing pin compresses the spring.

The central bore through the sear 22 and its associated handle 24 encloses a substantially cylindrical rod, or arming pin, 28, which is shown at its extreme rearward position where its shoulder abuts against a motion-restraining shoulder 30 of the sear 22. The arming pin 28 has a peripheral notch, or groove, 32 between its shoulder and its rear end 34. A spring, the arming-pin spring 36, extends inside the sear 22 between the forward end of the arming pin and the rear surface of forward end of the firing pin. The arming-pin spring 36, also, is preferably a coil spring. If desired, a hollow beneath each ball 46 can be substituted for the groove 32.

The sear 22 is locked to the firing pin by at least one (preferably more) firing-pin lock ball 38 which is located in a hole 40 in the firing pin 14 and sits in a concave depression or hollow, 42 in the periphery of the sear 22. Instead of an individual hollow for each ball, a peripheral notch, or groove, may be used, if desired. The balls 38 will hold the firing pin 14 in the location shown unless a pulling force is applied to the handle 24 when the firing device is in the armed position.

The sear is locked to the housing 10 by two means. It is prevented from going past a predetermined forward position, as shown in FIG. 1, by an external flange 31 which engages the rear end of the housing cap 12. In this position, the sear 22 is also prevented from moving backwards. This is accomplished by forming the inside of the cap 12 with a restraining shoulder 44 and placing at least one (preferably more) sear-lock ball 46 in a hole 48 in the sear 22. With the arming pin 28 in the safetied position, as shown in FIG. 1, the ball 46 abuts the cap shoulder 44 and restrains the sear 22 from being pulled rearward (to the left). If the sear 22 cannot be pulled rearward, the device cannot be fired. The distance between the forward edge of the flange 31 and the rear edge of the hole 48 in the sear is designed so that the sear-lock balls 46 will abut the restraining shoulder 44 on the cap when the flange 31 abuts the rear end of the cap 12.

Figure 2:
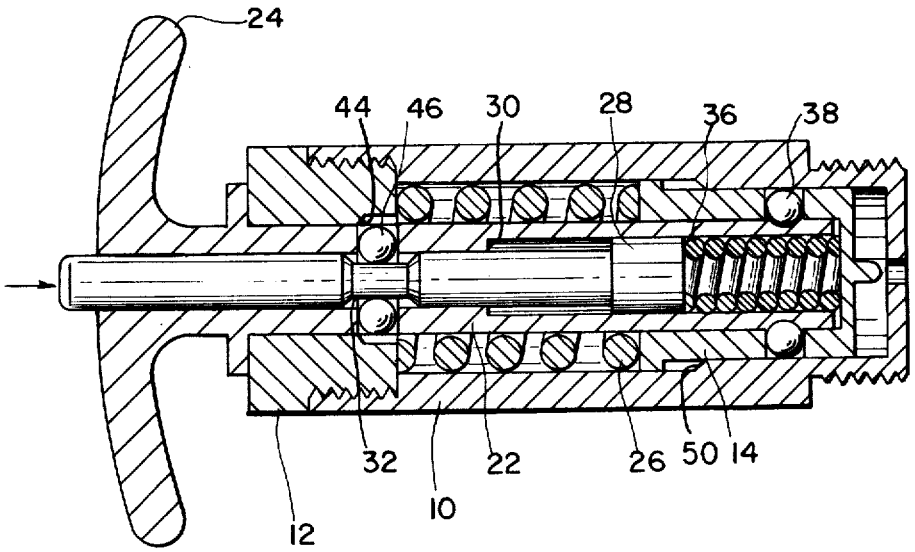
FIG. 2 is a cross-sectional view of the embodiment of FIG. 1 with the device in an armed condition.

In operation, the arming pin 28 is pushed forward until the hollow or groove, 32 lines up with the sear-lock balls 46. The latter fall into the hollow 32. The firing device is now in its armed condition, as shown in FIG. 2, i.e., the sear-lock balls 46 no longer abut against nor are restrained by the cap shoulder 44.

Figure 3:
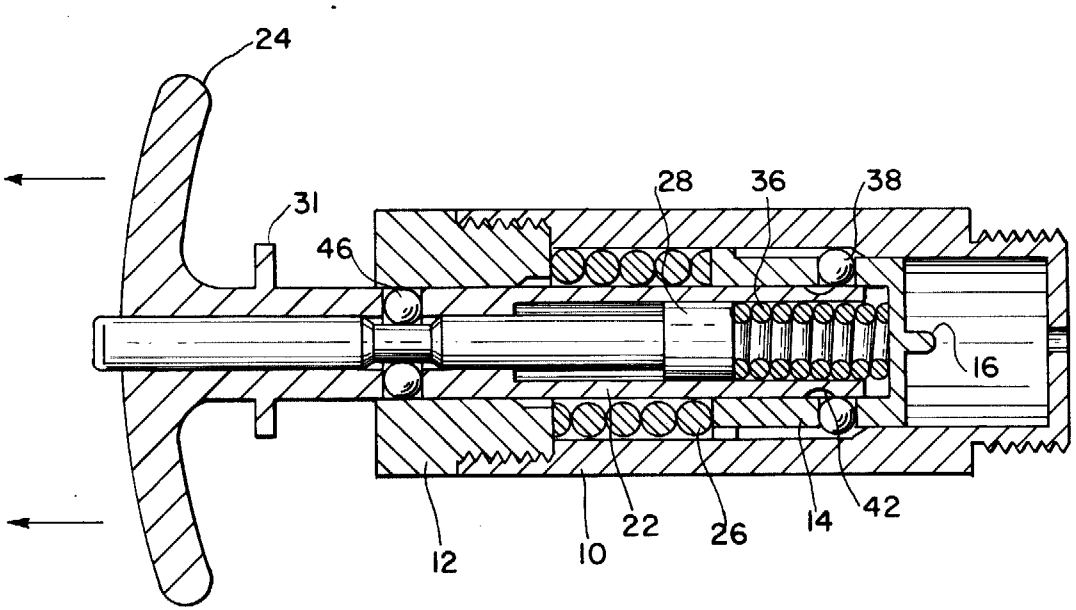
FIG. 3 is a cross-sectional view of the embodiment of FIG. 1 with the sear being in a released condition.

To fire the cartridge, the handle 24 is pulled to the rear (left) (see FIG. 3). Since movement of the sear 22 is no longer restrained by the sear-lock balls 46, the sear 22 moves rearward taking the firing pin 14 along with it. The rearward force on the sear 22 is transmitted through the firing-pin lock balls 38 to the firing pin 14 causing rearward motion of the latter. When the firing pin is moved sufficiently rearward, the firing pin lock balls 38 are no longer radially restrained by the housing 10 and are pushed into the space between the firing pin 14 and the housing 10 rearward of shoulder 50 by the rearward force on the sear 22. When this occurs, the firing pin 14 is freed from the sear 22 and the compressed firing-pin spring propels the firing pin 14 forward so that the nipple 16 goes through the hole 18 in the housing 10, striking the cartridge primer (not shown) and exploding it. The firing mechanism can also be called the "triggering means."

Obviously, many modifications and variations of the present invention are possible in light of the above teachings. It is therefore to be understood that, within the scope of the appended claims, the invention may be practiced otherwise than as specifically described.

What is claimed is:

1. A dual-motion firing device comprising:

a housing having front and rear portions;

a firing mechanism substantially internal to said housing means, said firing mechanism including a sear slidable in and extending out of said housing at its rear end portion, a firing pin within said housing that slidably engages an end portion of said sear, means non-permanently locking said firing pin to said sear, and resilient means for propelling said firing pin forward when said firing pin is unlocked from said sear by movement of said sear toward said rear portion of said housing;

an arming mechanism comprising means non-permanently locking said sear to said housing means, and an arming pin slidable within said sear having an arming pin resilient means adjacent its forward end portion and extending out of said sear at its rear end portion, said arming pin being formed with means for unlocking said sear from said housing when said arming pin is moved toward said firing pin to compress said arming pin resilient means;

whereby force on the arming pin moves it into said housing causing said sear to be permanently unlocked from said housing means by interaction of the arming pin resilient means and said means for unlocking said sear, and thereafter applying a pulling force on said sear to move it out of said housing causing said firing pin to move with said sear a predetermined distance at which unlocking of said firing pin from said sear occurs and said firing pin is propelled forward by said propelling means.

2. A firing device as in claim 1, wherein said sear is formed with a flange-like portion external to said housing means, said flange-like portion engaging said rear end portion of said housing for preventing said sear from movement within said housing past a predetermined point.

3. A firing device as in claim 1, wherein said housing means is formed with an internal shoulder, said sear is formed with at least one hole therein, said arming pin is formed with at least one peripheral hollow therein, and said means for nonpermanently locking said sear to said housing means includes at least one ball which is located in said sear hole and abuts said housing-means shoulder to prevent rearward motion of said sear until said arming pin is moved forward to place said hollow under said ball thereby allowing said ball to drop out of abutment with said shoulder.

4. A firing device as in claim 1, wherein said housing means is formed with a shoulder to the rear of said firing pin and said firing mechanism further includes biasing means located between said housing-means shoulder and said firing pin, said biasing means exerting an increasingly strong forward force on said firing pin as said firing pin is moved backward.

5. A dual-motion firing pin device comprising:

a tubular housing having front and rear portions;

a firing mechanism substantially internal to said tubular housing means, said firing mechanism including a tubular sear slidable in and extending out of said tubular housing at its rear end portion, a tubular firing pin encircling the front end of said tubular sear said firing pin having a cap at its front end and having a frontward-extending nipple centrally located on said cap within said tubular housing that slidably engages an end portion of said tubular sear, means non-permanently locking said tubular firing pin to said tubular sear and means for propelling said tubular firing pin forward when said tubular firing pin is unlocked from said tubular sear by rearward movement of said tubular sear; and an arming mechanism comprising means non-permanently locking said tubular sear to said tubular housing means, and an arming pin slidable within said tubular sear and extending out of said tubular sear at its rear end portion, said arming pin being formed with means for unlocking said sear when said arming pin is moved toward said firing pin;

biasing means between said cap and the front end of said arming pin for controlling the forward movement of said arming pin; whereby force on the arming pin moves it into the tubular housing causing said tubular sear to be unlocked from said tubular housing means, and thereafter applying force on the tubular sear to move it out of the tubular housing causing said tubular firing pin to move with the sear a predetermined distance at which unlocking of said firing pin from said tubular sear occurs and said tubular firing pin is propelled forward by said propelling means.

6. A firing device as in claim 5, wherein said firing pin is formed with at least one hole, said sear is formed with at least one peripheral hollow and said firing mechanism includes at least one ball located in said hole and sitting in said hollow when said sear is in its most frontward position, said ball, hole and hollow acting to lock said firing pin to said sear until said sear is moved to the rear to a point where said firing-pin biasing means forces the ball out of the hollow and propels the firing pin forward.

7. A dual-motion firing device comprising:

a tubular housing having a tubular cap at its rear end and formed with a centrally located hole in its forward end, said cap being formed with an internally located shoulder;

a tubular sear slidable within said housing, part of the sear extending outside said cap, said sear being formed with at least one peripheral hollow near its forward end and with at least one peripheral hole farther towards its rear end;

a cylindrical arming pin slidable within said sear and extending outside the rear end of said sear when it is in its rearmost position, said arming pin being formed with at least one peripheral hollow therein;

at least one sear-lock ball fitting into said hole in said sear and abutting said shoulder in said cap when said arming pin is at its rearmost position;

a tubular firing pin encompassing the forward end of said sear and formed at its forward end with a centrally located nipple which can fit through and extend beyond said hole in the forward end of said housing, said firing pin being formed with at least one hole in its tubular side;

at least one firing-pin lock ball fitting in said hole in the side of said firing pin and lying in said peripheral hollow of said sear to nonpermanently lock said firing pin to said sear;

an arming-pin spring located inside said sear between the forward ends of said arming pin and said firing pin; and a firing-pin spring located between the rear end of said firing pin and the front end of said cap, so that, when said arming pin is pushed forward, said arming-pin hollow slides under said sear-lock ball allowing it to slip down and lose contact with said cap shoulder to break the lock between sear and housing and, thereafter, when said sear is pulled backward, a point is reached when said firing pin-lock ball is forced out of said hollow in said sear, unlocking said firing pin and permitting said firing-pin spring to propel said firing pin forward.

* * * * *